US007292808B2

(12) United States Patent
Murofushi

(10) Patent No.: US 7,292,808 B2
(45) Date of Patent: Nov. 6, 2007

(54) IMAGE FORMING APPARATUS AND PROCESS UNIT

(75) Inventor: Takeru Murofushi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 169 days.

(21) Appl. No.: 11/184,887

(22) Filed: Jul. 20, 2005

(65) Prior Publication Data

US 2007/0019990 A1 Jan. 25, 2007

(51) Int. Cl.
*G03G 15/00* (2006.01)

(52) U.S. Cl. ..... 399/167; 399/88; 399/111

(58) Field of Classification Search ..... 399/167, 399/111, 121, 116, 117, 110, 88
See application file for complete search history.

(56) References Cited

U.S. PATENT DOCUMENTS 5,583,630 A * 12/1996 Kimura et al. ..... 399/227
6,839,532 B2 * 1/2005 Hoashi ..... 399/167
7,016,627 B2 * 3/2006 Shibuya et al. ..... 399/167
2003/0202818 A1 * 10/2003 Sameshima ..... 399/111
2005/0025520 A1 * 2/2005 Murakami et al. ..... 399/111
2005/0111881 A1 * 5/2005 Arimitsu et al. ..... 399/167
2005/0214023 A1 * 9/2005 Foster et al. ..... 399/110

FOREIGN PATENT DOCUMENTS

JP 02-287577 A 11/1990
JP 06-332285 A 12/1994
JP 2001-005291 A 1/2001

* cited by examiner

*Primary Examiner*—Sophia S. Chen
(74) *Attorney, Agent, or Firm*—Foley & Lardner LLP

(57) ABSTRACT

An image forming apparatus of the present invention attaches a process unit to a body frame, thereby fits a third coupling into a second coupling of a drive transfer device, forms the Oldham structure, absorbs a shift between axial centers of a belt side shaft and a belt drive shaft, and always presses the second coupling toward the third coupling by a coil spring, absorbs a shift in the parallel direction with a belt side shaft 32*a*, thereby surely fits the third coupling into the second coupling, even if the axial center of the belt side shaft is shifted from the axial center of the belt drive shaft due to distortion of the unit, rotates stably the transfer belt, causes no distortion to a transfer image, and obtains high color superimposition precision.

12 Claims, 6 Drawing Sheets

IMAGE FORMING APPARATUS AND PROCESS UNIT

FIELD OF THE INVENTION

The present invention relates to an image forming apparatus and a process unit used for a copier and a printer for easily mounting and demounting or exchanging the process unit integrally incorporating a photoconductor and a transfer belt.

DESCRIPTION OF THE BACKGROUND

Among image forming apparatuses for obtaining color images by the electro-photographic method such as a color copier or a color printer. There is an apparatus for transferring toner images of various colors formed on a photosensitive drum using an endless transfer belt available. As an apparatus using the transfer belt, there are an apparatus for feeding a sheet of paper between the transfer belt and the photosensitive drum and transferring a toner image on the photosensitive drum directly to the sheet of paper and an apparatus for primarily transferring the toner image on the photosensitive drum to the transfer belt and then secondarily transferring it to the sheet of paper. In the image forming apparatus using the transfer belt, for miniaturization of the apparatus or improvement of the maintainability, in recent years, there is an apparatus using a process unit for uniting the photosensitive drum, a main charger, a cleaner, and the transfer belt and mounting or demounting them from the main unit. The process unit drives the photosensitive drum and transfer belt by a motor installed in the main unit.

However, when driving the process unit having drive mechanisms such as the photosensitive drum and transfer belt by the motor installed in the main unit. There are possibilities that depending on the part precision or assembly precision of the process unit, the axial center of each drive mechanism may be shifted. When the axial centers of the photosensitive drum and transfer belt are shifted, the driving thereof becomes unstable and the image quality is lowered remarkably. Therefore, even if the axial centers are shifted, it is required to drive stably the photosensitive drum and transfer belt.

On the other hand, in Japanese Patent Application Publication No. 2001-5291, an apparatus in which a developing roller of a process unit is connected to a drive means of the main unit by the Oldham structure is disclosed.

However, the conventional Oldham structure can absorb a shift or a deviation of the axial center in the perpendicular direction to the shaft of the developing roller but cannot absorb a shift in the parallel direction with the axial center. Therefore, when the process unit is mounted in the apparatus body, there is a fear that the connection of the developing roller with the drive means of the main unit becomes unstable. When the connection with the drive means of the main unit becomes unstable like this, a transfer image is distorted and particularly on the transfer belt for superimposing toner images of a plurality of colors and obtaining a full-color image, color slipping is caused by vibration of the transfer belt, and the image quality may be lowered.

Therefore, an image forming apparatus and a process unit are desired such that when the process unit having a transfer belt is mounted on the apparatus body, regardless of a shift due to the manufacture precision of the process unit, the belt drive shaft of the transfer belt is surely connected to a motor via the Oldham structure, and the transfer belt is prevented from vibration, thus the image quality is improved.

SUMMARY OF THE INVENTION

Accordingly, an advantage of the present invention is to provide an image forming apparatus and a process unit for preventing a transfer belt of the process unit from vibration, superimposing toner images of a plurality of colors with high precision, thereby obtaining a high image quality.

To achieve the above advantage, one aspect of the present invention is to provide an image forming apparatus including a body frame, a process unit having an image carrying member, an endless transfer belt member opposite to the transfer position of the image carrying member, and a belt drive member to rotate the transfer belt member which can be integrally mounted or demounted from the body frame, an image forming member to form a toner image on the image carrying member, a drive source to drive the belt drive member, a drive transfer member existing between the drive source and the belt drive member capable of sliding in the parallel direction with and perpendicular direction to the drive shaft of the drive source and to the belt side shaft of the belt drive member, and a fitting member provided at the front end of the belt side shaft to fit into the drive transfer member by mounting the transfer belt member on the body frame.

DETAILED DESCRIPTION OF THE INVENTION

Figure 1:
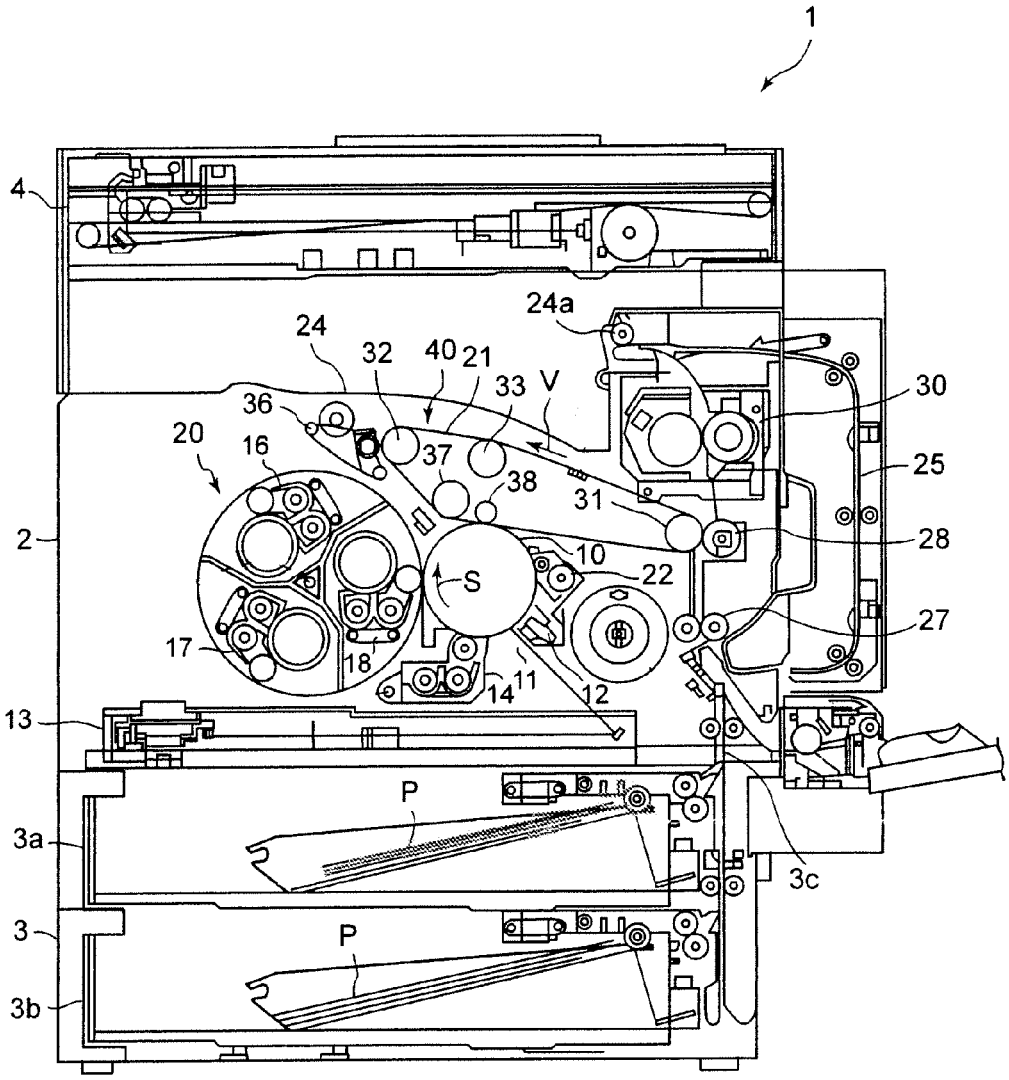
FIG. 1 is a schematic view showing schematically the color printer of the embodiment of the present invention.

Hereinafter, the embodiment of the present invention will be explained in detail with reference to the accompanying drawings. FIG. 1 is a schematic view showing color printer 1 which is the image forming apparatus of the embodiment of the present invention. In color printer 1, paper supply device 3 for supplying sheets of paper P, which are recording media, toward printer 2 is installed. Paper supply device 3 takes out sheets of paper P form paper supply cassettes 3*a* and 3*b* and supplies sheets of paper P toward register rollers 27 along conveying path 3*c*. On the top of color printer 1, scanner 4 for reading a document image is installed.

Around photosensitive drum 10 which is an image carrying member of printer 2, a toner image forming unit 11 which is an image forming member for forming toner images of a plurality of colors on photosensitive drum 10 is installed. Toner image forming unit 11 includes a main charger 12 for uniformly charging photosensitive drum 10 sequentially in the rotational direction of arrow s of photosensitive drum 10, laser exposure device 13 for forming an electrostatic latent image on charged photosensitive drum 10 on the basis of image data from scanner 4, and revolver type color developing apparatus 20 loading black developing device 14, yellow (Y) developing device 16, magenta (M) developing device 17, and cyan (C) developing device 18.

Figure 2:
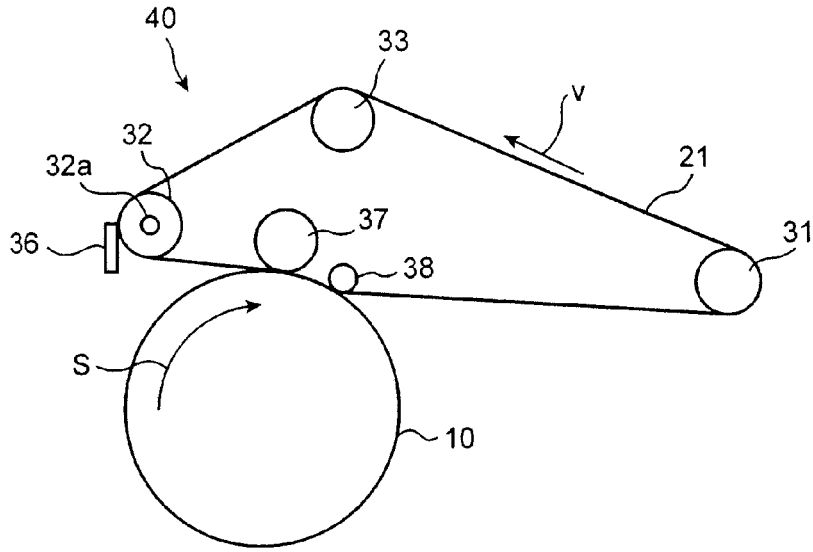
FIG. 2 is a block diagram showing schematically the transfer belt device of the embodiment of the present invention.

Furthermore, at the transfer position around photosensitive drum 10, transfer belt device 40 is arranged opposite to it. Transfer belt device 40 has transfer belt 21 which is a transfer belt member. Transfer belt 21, as shown in FIG. 2, is stretched by belt drive roller 32 which is a belt drive member, driven roller 31, and tension roller 33. The contact position of transfer belt 21 with photosensitive drum 10 is supported by primary transfer roller 37 for applying a primary transfer bias and auxiliary roller 38. Furthermore, to the secondary transfer position supported by driven roller 31 of transfer belt 21, secondary transfer roller 28 to which a secondary transfer bias is applied is opposite. Around transfer belt 21 after passing the secondary transfer position, belt cleaner 36 is installed. Further, on the downstream side of transfer belt 21 around photosensitive drum 11, cleaner 22 is arranged.

Figure 3:
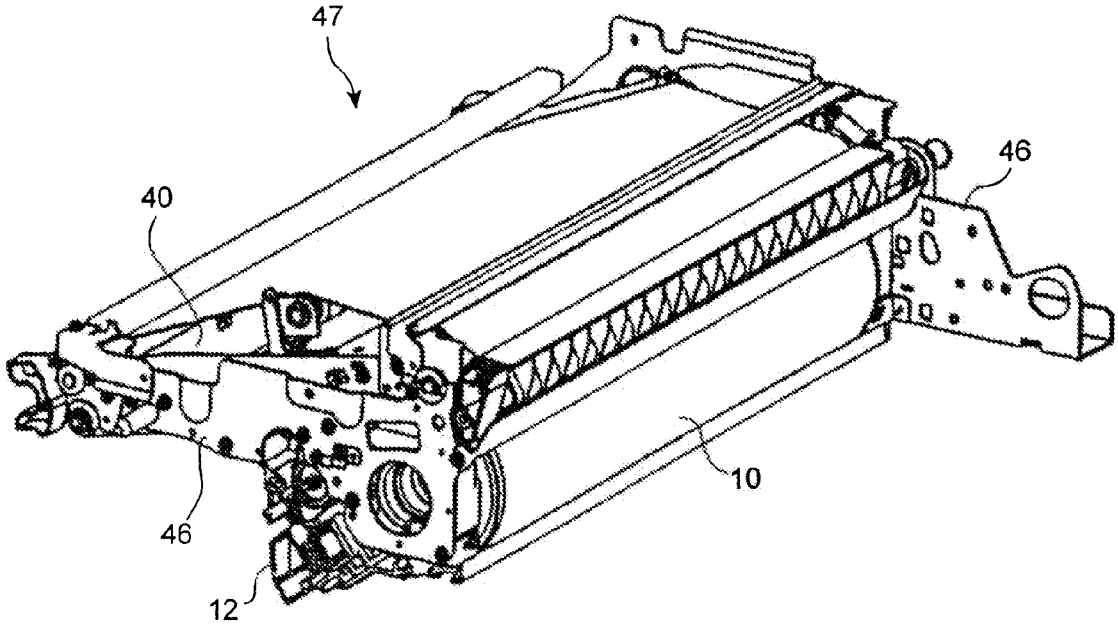
FIG. 3 is a perspective view showing the process unit of the embodiment of the present invention.

Photosensitive drum 11, main charger 12, transfer belt device 40, and cleaner 22, as shown in FIG. 3, are integrally supported by unit frame 46 and form process unit 47. Further, printer 2 includes secondary transfer roller 28 for secondarily transferring toner images of a plurality of colors superimposed on transfer belt 21 to sheet of paper P, fixing device 30 for fixing the toner images on sheet of paper P, and paper ejection roller 24*a* for ejecting sheet of paper P after fixing to paper ejection unit 24. Furthermore, printer 2 has reversible conveying path 25 for reversing sheet of paper P at time of double-side image forming.

Figure 4:
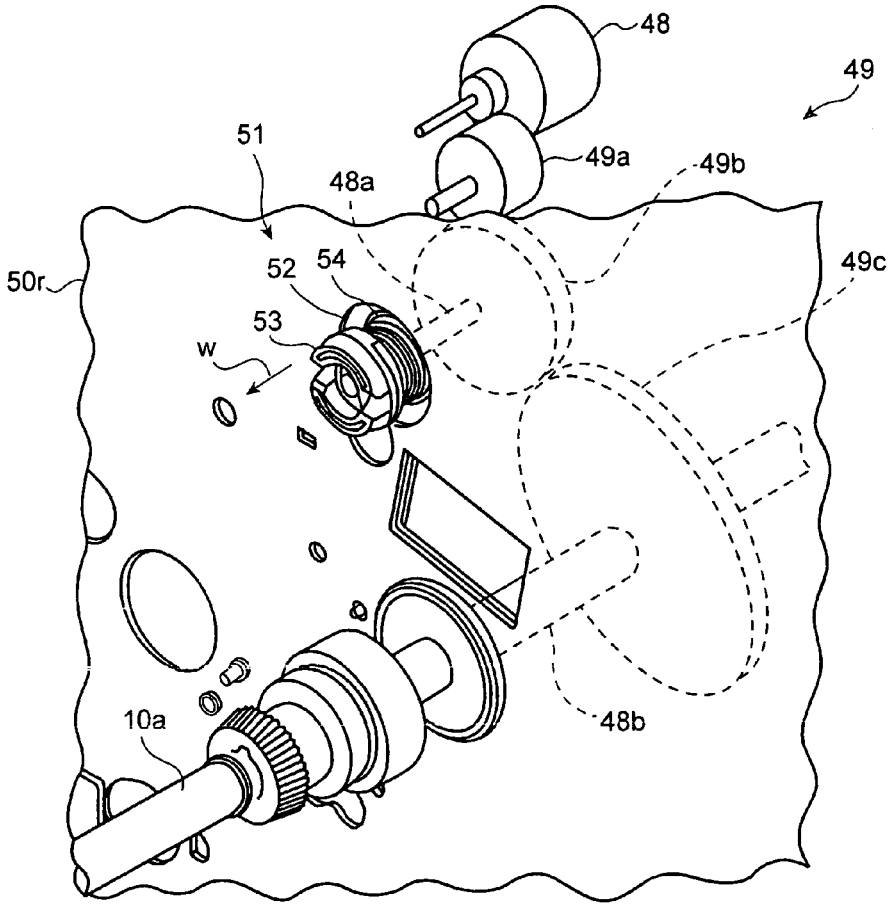
FIG. 4 is a perspective view showing a part of the rear frame of the embodiment of the present invention.
Figure 5:
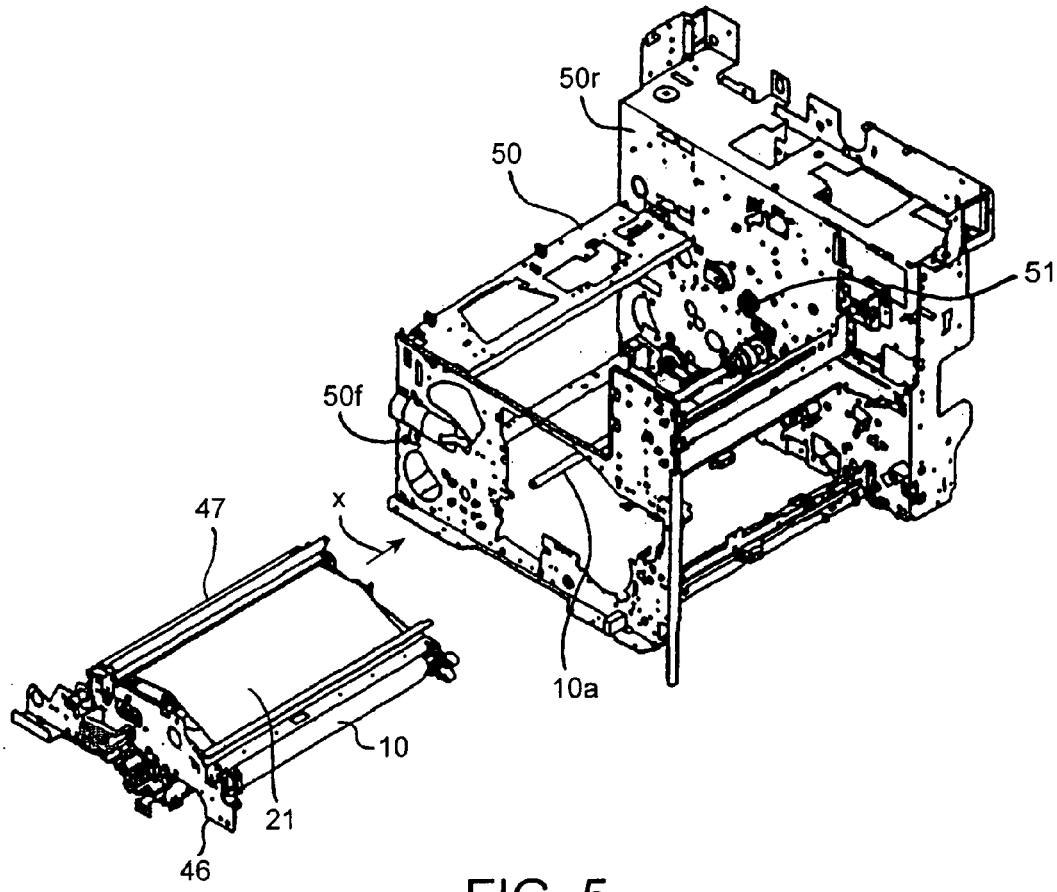
FIG. 5 is a schematic illustration showing mounting and demounting of the process unit from the body frame of the embodiment of the present invention.

Further, as shown in FIGS. 4 and 5, on rear frame 50*r* of body frame 50 of printer 2, motor 48 which is a drive source is installed. The drive of motor 48 is transferred to belt drive shaft 48*a* which is a drive shaft for driving belt drive roller 32 and drum drive shaft 48*b* for driving photosensitive drum 10 via link mechanism 49 having first to third gears 49*a* to 49*c*. Process unit 47 mounted or demounted from front frame 50*f* of body frame 50 is connected by setting the position where the position of drum drive shaft 48*b* and the position of drum shaft 10*a* of photosensitive drum 10 coincide with each other as a reference position.

Therefore, when there are variations in the manufacture precision of process unit 47, a shift is caused between belt drive shaft 48*a* on the main unit side and belt side shaft 32*a* of belt drive roller 32, so that to absorb this shift, drive transfer device 51 which is a drive transfer member is installed. Next, by referring to FIGS. 6 and 7, drive transfer device 51 will be described in detail. Drive transfer device 51 has first and second couplings 52 and 53. First and second couplings 52 and 53 can slide in the parallel direction with belt drive shaft 48*a* between first e ring 56*a* and second e ring 56*b*. Further, between first coupling 52 and first e ring 56*a*, coil spring 54 which is a pressing member is installed and presses first and second couplings 52 and 53 toward the front end of belt drive shaft 48*a*, that is, in the direction of arrow w.

Belt drive shaft 48*a* is fit into inner diameter 52*a* of first coupling 52, and first coupling 52 is rotated integrally with belt drive shaft 48*a*, though it can slide and move on belt drive shaft 48*a*. On the other hand, inner diameter 53*a* of second coupling 53 is formed with play for belt drive shaft 48*a* and second coupling 53 can move perpendicularly to belt drive shaft 48*a*. First projection 53*b* of second coupling 53 is fit into first notch 52*b* formed on the periphery of first coupling 52.

Figure 7:
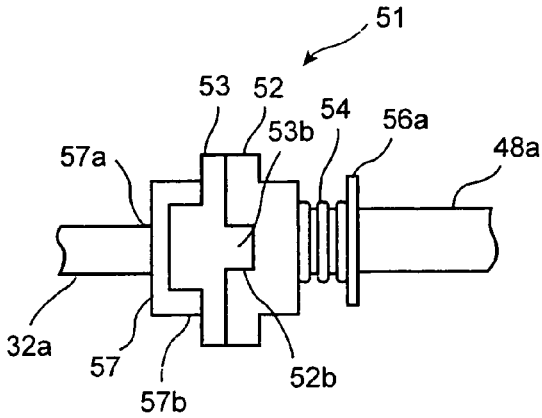
FIG. 7 is a side view showing schematically the transfer belt when the drive transfer unit and the third coupling of the embodiment of the present invention form the Oldahm structure.
Figure 6:
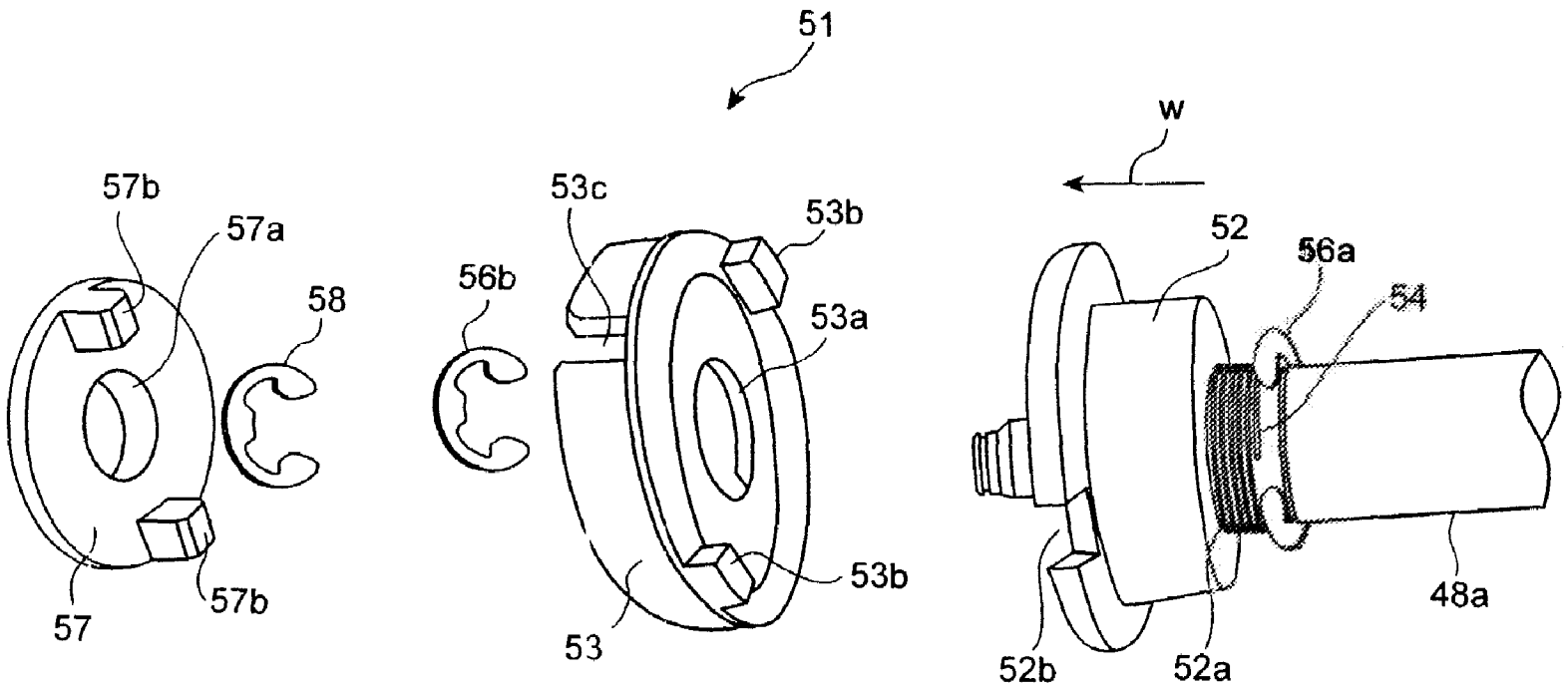
FIG. 6 is a dispersion perspective view showing the drive transfer unit and the third coupling of the embodiment of the present invention.
Figure 8:
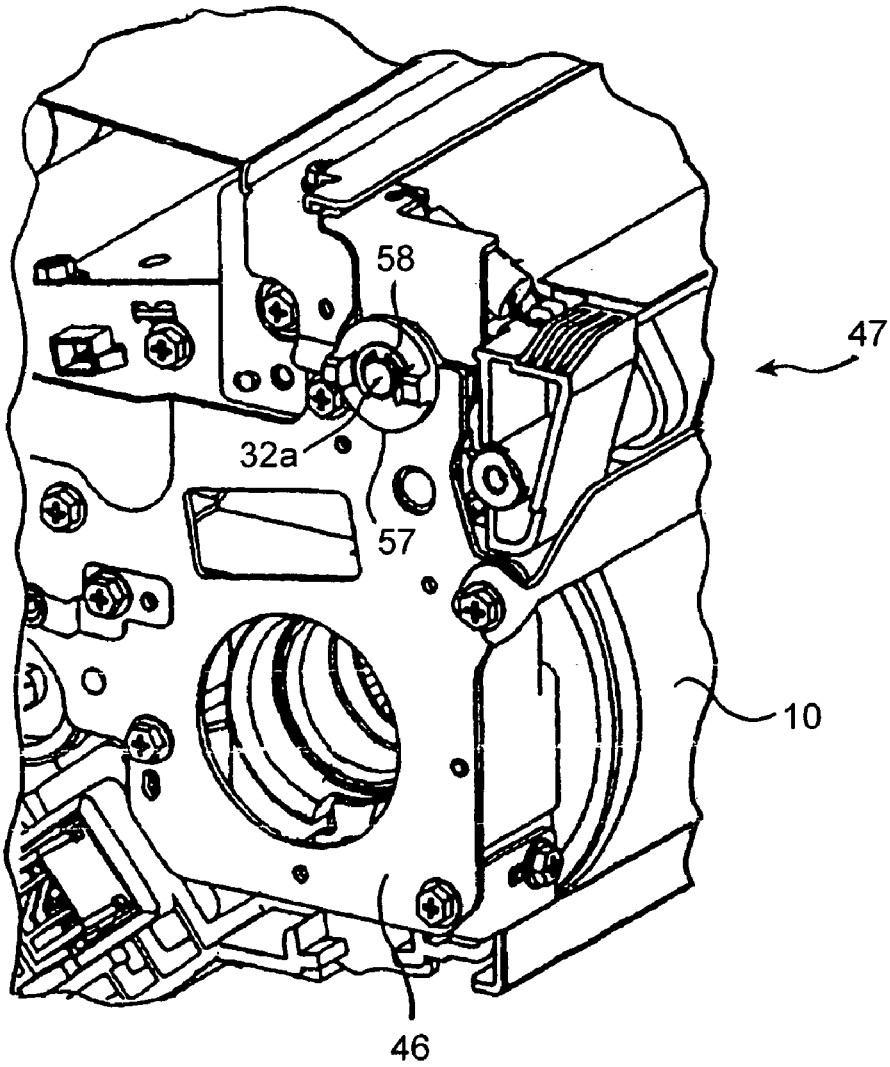
FIG. 8 is a perspective view showing a part of the unit frame of the process unit of the embodiment of the present invention.

Further, as shown in FIGS. 6 to 8, to the front end of belt side shaft 32*a* of belt drive roller 32 of process unit 47, third coupling 57 which is a fitting member is attached by third e ring 58. Belt side shaft 32*a* is fit into inner diameter 57*a* of third coupling 57 and third coupling 57 is rotated integrally with belt side shaft 32*a*. When process unit 47 is mounted on body frame 50, second projection 57*b* of third coupling 57 is fit into second notch 53*c* formed on second coupling 53.

Third coupling 57 is fit into second coupling 53, thus between belt drive shaft 48*a* and belt side shaft 32*a* of drive roller 32, the Oldham structure is formed. Namely, even if the axial centers of belt drive shaft 48*a* and belt side shaft 32*a* of drive roller 32 are shifted, in second coupling 53, first projection 53*b* slides along first notch 52*b* for first coupling 52 and second notch 53*c* slides along second projection 57*b* for third coupling 57. As a result, second coupling 53 moves perpendicularly to belt drive shaft 48*a* and absorbs the shift between the axial centers of belt drive shaft 48*a* and belt side shaft 32*a* of driver roller 32.

Next, the print process by color printer 1 will be explained. Color printer 1, so as to superimpose toner images on sheet of paper P in the order of yellow (Y), magenta (M), cyan (C), and black (BK) to obtain a full-color image, forms toner images in the order of black (BK), cyan (C), magenta (M), and yellow (Y) by toner image forming unit 11.

When the image forming process starts and scanner 4 reads a document, in printer 2, photosensitive drum 10 of process unit 47 is driven by motor 48 to rotate in the direction of arrow s and transfer belt 21 is rotated in the direction of arrow v. At this time, between belt drive shaft 48*a* and belt side shaft 32*a*, the Oldham structure is formed by drive transfer device 51. Therefore, even if the arrangement of drum shaft 10*a* on the side of process unit 47 and belt side shaft 32*a* of belt drive roller 32 is shifted from the arrangement of drum drive shaft 48*b* and belt drive shaft 48*a* which are driven by motor 48 and the axial centers of belt drive shaft 48*a* and belt side shaft 32*a* are shifted, the shift between the axial centers is absorbed by drive transfer device 51 and transfer belt 21 is rotated stably.

Photosensitive drum 10 is charged by main charger 12 according to rotation, and an electrostatic latent image is formed according to a document by laser exposure device 13, and a toner image is formed by black developing device 14 or color developing apparatus 20. Next, the toner image on photosensitive drum 10 reaches the primary transfer position which is a contact position with transfer belt 21 rotating in the direction of arrow v and is primarily transferred onto transfer belt 21 by application of a transfer bias from primary transfer roller 37. After the primary transfer, photosensitive drum 10 is cleaned off residual toner by cleaner 22.

Hereafter, for each color of each toner image, the toner image forming process by the electro-photographic method aforementioned is repeated on photosensitive drum 10, and at the same position on transfer belt 21, the toner images of a plurality of colors are sequentially transferred and superimposed primarily, and a full-color toner image is obtained on transfer belt 21. Hereafter, the full-color toner image on transfer belt 21 reaches the secondary transfer position and is secondarily transferred onto sheet of paper P in a batch by the transfer bias of secondary transfer roller 28.

Sheet of paper P, in synchronization with arrival of the full-color toner image on transfer belt 21 at the secondary transfer position, is conveyed from paper supply device 3 to the secondary transfer position. Hereafter, sheet of paper P, after the full-color toner image is fixed by fixing device 30 and a color image is completed, is stacked on paper ejection unit 24. On the other hand, after end of transfer to sheet of paper P, transfer belt 21 is cleaned off residual toner by belt cleaner 36.

While the image forming process is repeated like this, transfer belt 21 is driven by belt drive shaft 48*a* via drive transfer device 51 to rotate stably. Further, when the life of process unit 47 has expired, used process unit 47 is pulled out on the side of front frame 50*f* of body frame 50. Then, new process unit 47 is slid in the direction of arrow x shown in FIG. 5 and is attached to frame 50.

Namely, into second notch 53*c* formed on second coupling 53 of drive transfer device 51 attached at the front end of belt drive shaft 48*a* on the side of rear frame 50*r*, second projection 57*b* of third coupling 57 at the front end of belt side shaft 32*a* on the side of process unit 47 is fit. At this time, second coupling 53 is pressed by coil spring 54 in the direction of the arrow. Therefore, even if belt side shaft 32*a* of process unit 47 is shifted in the parallel direction with the shaft, it is absorbed by coil spring 54 and second coupling 53 and third coupling 57 are surely fit into each other to Oldham structure. As a result, even if the axial center of belt side shaft 32*a* of new process unit 47 is shifted from the axial center of belt drive shaft 48*a*, the shift of the axial center is absorbed by drive transfer device 51, and transfer belt 21 is rotated stably free of vibration, and a transfer image of high image quality free of distortion is obtained, and a high image quality free of color slip with high color superimposition precision is obtained.

According to this embodiment, in process unit 47 having photosensitive drum 10 and transfer belt 21, even if the arrangement of drum shaft 10*a* and belt side shaft 32*a* is shifted from the arrangement of drum drive shaft 48*b* and belt drive shaft 48*a* on the side of rear frame 50*r*, when third coupling 57 of process unit 47 is fit into second coupling 53 on the side of rear frame 50*r*, the Oldham structure can be formed and the shift in the perpendicular direction to the axial centers of belt side shaft 32*a* and belt drive shaft 48*a* can be absorbed.

Further, when second coupling 53 is pressed toward third coupling 57 by coil spring 54, the shift in the parallel direction with belt side shaft 32*a* of process unit 47 can be absorbed and second coupling 53 and third coupling 57 can be surely fit into each other. Therefore, transfer belt 21 united with photosensitive drum 10 generates no vibration due to driving by belt drive shaft 48*a* and obtains a uniform and stable rotation. As a result, a transfer image free of distortion is obtained and at time of forming a color image, a color image of high image quality free of color slip with high color superimposition precision is obtained.

Further, the present invention is not limited to the embodiment aforementioned and can be modified variously within the scope of the present invention. For example, the process unit may have the image carrying member and transfer belt member and may include the developing device. Furthermore, in an image forming apparatus of a tandem type for forming toner images of different colors on a plurality of image carrying members and then superimposing toner images on the transfer belt member or a recording medium backed up by the transfer belt member to obtain a color image, a plurality of image carrying members may be arranged in the process unit. Further, the shape of the part where the drive transfer member and fitting member are fit into each other is not limited if the drive transfer member can slide satisfactorily and the drive transfer member and fitting member can be surely fit into each other. Furthermore, the image forming apparatus is not limited to a printer and may be a composite device (multi functional peripheral) or a facsimile or may be monochromatic.

As described above in detail, according to the present invention, when the process unit is mounted on the main unit of the image forming apparatus, the drive transfer member for connecting the belt side shaft of the transfer belt member to the drive shaft on the main unit side of the image forming apparatus can slide in the perpendicular direction and parallel direction with the axial centers of the belt side shaft and drive shaft. Therefore, the shift of the belt side shaft in the parallel direction with the shaft is absorbed and the fitting member and drive transfer member can be surely fit into each other and furthermore by the Oldham structure formed when they are fit, the shift between the axial centers of the belt side shaft and drive shaft can be absorbed. As a result, regardless of the shift due to the manufacture precision of the process unit, the transfer belt is prevented from vibration, and a transfer image free of distortion is obtained, and the color superimposition precision of toner images of a plurality of colors on the transfer belt can be improved, and an image forming apparatus for improving the image quality of color images is obtained.

What is claimed is:

1. An image forming apparatus, comprising:

a body frame;

a process unit removably attached integrally to the body frame having an image carrying member, an endless transfer belt member opposite to a transfer position of the image carrying member, and a belt drive member to rotate the transfer belt member;

an image forming member to form a toner image on the image carrying member;

a drive source to drive the belt drive member and the image carrying member;

a drive transfer member existing between the drive source and the belt drive member capable of sliding in a parallel direction with and a perpendicular direction to a drive shaft of the drive source and to a belt side shaft of the belt drive member; and a fitting member provided at a front end of the belt side shaft to fit into the drive transfer member by mounting the transfer belt member on the body frame.

2. The image forming apparatus according to claim 1, wherein the drive transfer member has a coupling and a pressing member to press the coupling toward the fitting member.

3. The image forming apparatus according to claim 2, wherein the pressing member is a compression spring.

4. The image forming apparatus according to claim 2, wherein when the process unit is mounted on the body frame, thus the fitting member is fit into the coupling, the coupling can slide in a parallel direction with the drive shaft and the belt side shaft.

5. The image forming apparatus according to claim 2, wherein when the process unit is mounted on the body frame, thus the fining member is fit into the coupling, an Oldham structure is formed and a shift in a perpendicular direction to the drive shaft and the belt side shaft is absorbed.

6. The image forming apparatus according to claim 1, wherein the transfer belt member is opposite to the toner image formed on the image carrying member.

7. The image forming apparatus according to claim 1, wherein the transfer belt member, after the toner image formed on the image carrying member is transferred primarily, transfers the toner image secondarily to a recording medium.

8. A process unit, comprising:

an image carrying member to form a toner image;

an endless transfer belt member opposite to a transfer position of the image carrying member;

a belt drive member driven by a drive source on a body side of an image forming apparatus to drive the transfer belt member; and a fining member provided at a front end of a belt side shaft of the belt drive member, by mounting the transfer belt member on the body side of the image forming apparatus, to fit into a drive transfer member capable of sliding in a parallel direction with and a perpendicular direction to a drive shaft of the drive source provided on the body side of the image forming apparatus to drive the belt drive member and to the belt side shaft, wherein the drive source provided on the body side of the image forming apparatus for driving the belt drive member drives the image carrying member.

9. The process unit according to claim 8, wherein when the transfer belt member is mounted on the body side of the image forming apparatus, thus the fitting member is fit into the drive transfer member, the drive transfer member slides in a parallel direction with the drive shaft and the belt side shaft.

10. The process unit according to claim 8, wherein the fitting member is mounted on the body side of the image forming apparatus, is fit into the drive transfer member, thereby forms an Oldham structure, and absorbs a shift in a perpendicular direction to the drive and the side shaft.

11. The process unit according to claim 8, wherein the transfer belt member is opposite to the toner image formed on the image carrying member.

12. The process unit according to claim 8, wherein the transfer belt member, after the toner image formed on the image carrying member is transferred primarily, transfers the toner image secondarily to a recording medium.

* * * * *